US007690518B2

(12) United States Patent
Fincher et al.

(10) Patent No.: US 7,690,518 B2
(45) Date of Patent: Apr. 6, 2010

(54) FRONT-LOADING RACK FOR DISPLAYING AND FIRST-IN, FIRST-OUT DISPENSING OF PRODUCTS

(75) Inventors: Rick Fincher, Mooresville, NC (US); David Fraser, Winston-Salem, NC (US); Gary Norton, King, NC (US)

(73) Assignee: Sonoco Development, Inc., Hartsville, SC (US)

( * ) Notice: Subject to any disclaimer, the term of this patent is extended or adjusted under 35 U.S.C. 154(b) by 301 days.

(21) Appl. No.: 11/778,726

(22) Filed: Jul. 17, 2007

(65) Prior Publication Data

US 2009/0020550 A1 Jan. 22, 2009

(51) Int. Cl.
*A47F 1/04* (2006.01)

(52) U.S. Cl. ..... 211/59.2

(58) Field of Classification Search ..... 211/59.2; 312/42, 45, 60, 61, 72, 73, 86; 221/281, 221/171–173; 414/276

See application file for complete search history.

(56) References Cited

U.S. PATENT DOCUMENTS

| | | | | | |
|---|---|---|---|---|---|
| 2,364,231 | A * | 12/1944 | MacNeill | 312/72 |
| 2,852,327 | A | 9/1958 | Mason | |
| 3,152,697 | A * | 10/1964 | Berman et al. | 211/59.2 |
| 4,205,763 | A * | 6/1980 | Merl | 221/173 |
| 4,732,282 | A | 3/1988 | Lockwood | |
| 5,396,997 | A * | 3/1995 | Johnson | 211/59.2 |
| 5,462,198 | A * | 10/1995 | Schwimmer | 221/130 |
| 5,582,326 | A | 12/1996 | Nishimura | |
| 5,788,117 | A * | 8/1998 | Zimmanck | 221/285 |
| 5,865,324 | A * | 2/1999 | Jay et al. | 211/59.2 |
| 5,878,862 | A | 3/1999 | Dewsnap | |
| 6,112,938 | A * | 9/2000 | Apps | 221/194 |
| 6,206,237 | B1 | 3/2001 | Dillon et al. | |
| 6,502,408 | B1 * | 1/2003 | Corcoran | 62/63 |
| 6,637,604 | B1 * | 10/2003 | Jay | 211/59.2 |
| 6,991,116 | B2 * | 1/2006 | Johnson et al. | 211/59.2 |
| 7,207,447 | B2 * | 4/2007 | Medcalf et al. | 211/59.2 |
| 2007/0007221 | A1 * | 1/2007 | Mann | 211/59.3 |

* cited by examiner

*Primary Examiner*—Janet M Wilkens
*Assistant Examiner*—Dan Rohrhoff
(74) *Attorney, Agent, or Firm*—Alston & Bird LLP

(57) ABSTRACT

A rack includes a loading chute into which products are loaded in a generally horizontal face-down orientation, and a dispensing chute defining a dispensing aperture at the front side of the rack. A cam is disposed at the rear end of the loading chute to tilt a product into an upright orientation and to position the upright product with the front face facing forward. The cam also slopes downwardly in a lateral direction so as to move the upright product onto the rear end of the dispensing ramp with the front face still facing forward. The product slides down the dispensing ramp and is stopped by a stop positioned adjacent the dispensing aperture. By virtue of the rack's design, facilitated by the specially designed cam, the upright product is positioned with its front face facing forward such that a consumer can view any indica thereon.

22 Claims, 3 Drawing Sheets

FRONT-LOADING RACK FOR DISPLAYING AND FIRST-IN, FIRST-OUT DISPENSING OF PRODUCTS

BACKGROUND OF THE INVENTION

The invention relates to a rack for displaying and first-in, first-out dispensing of products such as products or jars for retail sale. More particularly, the invention relates to such a rack that is front-loading and front-dispensing.

In many conventional display racks, a row of product is held in a lane or chute arranged on a store shelf such that only the first product in the row is visible and accessible to the consumer. When the first product is removed, the entire row of product is moved forward either by a spring mechanism or by gravity so that the second product in the row is moved forward to the front of the chute for access by the consumer.

When reloading or topping off a rack, it is generally desirable to "rotate" the stock by loading new products such that they are at the back of the row of products, so that the first products dispensed are the older products that were already in the rack (i.e., "first in, first out" or "FIFO" dispensing). This rotation of stock can be cumbersome with many conventional racks because it may require opening up the rack, which may be difficult to do in the limited space typically available on the store shelf.

Generally, each of the products to be displayed and dispensed includes a front face having a label or the like with indicia (e.g., text and/or graphics indicating what type of product it is, etc.) that the consumer would like to be able to view. It is desirable for the indicia to be viewable without having to remove one of the products from the rack. With many existing first-in, first-out dispensing racks, this is not possible because there is no assurance that the product will be oriented with its front face facing forwardly when it arrives at the front of the line of products.

BRIEF SUMMARY OF THE DISCLOSURE

The present disclosure relates to a front-loading and front-dispensing rack for displaying and first-in, first-out dispensing of products, designed in such a way that there is virtual assurance that the front face of a product ready for dispensing will face forwardly and be viewable without having to first remove the product from the rack. Additionally, the rack is designed such that it can be loaded with new products without having to access any part of the rack except its front side.

In accordance with one embodiment, a rack is described herein that is configured for displaying and first-in, first-out dispensing of a plurality of products of substantially identical configuration each having a bottom end configured to support the product in an upright orientation resting on the bottom end. The rack includes a loading chute defining a loading aperture at a front side of the rack and extending rearwardly therefrom, the loading chute including a loading ramp extending from the loading aperture to a rear end of the loading ramp, the loading chute being configured to receive the products one at a time, bottom end first, in a horizontal orientation with a front face of each product against the loading ramp. The rack further includes a dispensing chute defining a dispensing aperture at the front side of the rack and extending rearwardly therefrom, the dispensing chute including a dispensing ramp that slopes downwardly from a rear end of the dispensing ramp to a front end thereof.

A cam is disposed at the rear end of the loading ramp, the cam sloping downwardly in a rearward direction at a substantially steeper angle than the rear end of the loading ramp so as to tilt a product sliding off the rear end of the loading ramp into an upright orientation and to position the upright product with the front face facing forward. The cam also slopes downwardly in a lateral direction so as to move the upright product onto the rear end of the dispensing ramp with the front face still facing forward. The product slides down the dispensing ramp and is stopped by a stop positioned adjacent the dispensing aperture. By virtue of the rack's design, facilitated by the specially designed cam, the upright product is positioned with its front face facing forward such that a consumer can view any indicia on the front face without having to withdraw the product from the dispensing aperture.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

The present inventions now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 3:
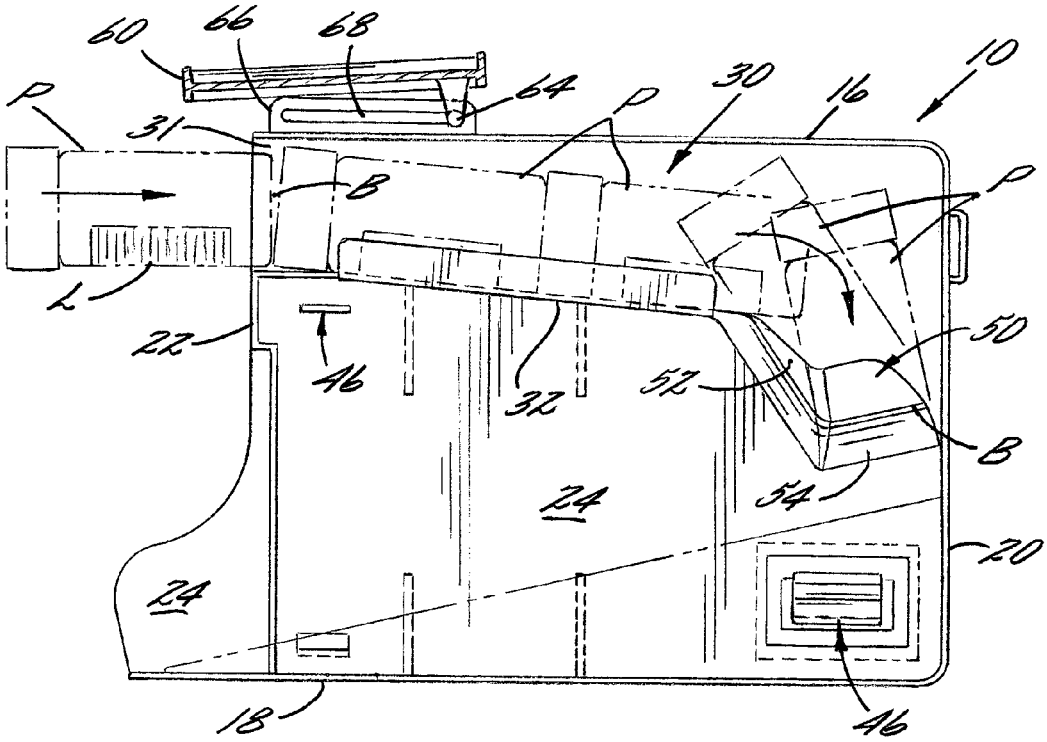
FIG. 3 is a cross-sectional view along line 3-3 in FIG. 2.

In the description and claims, and with reference to FIG. 3, the "forward" direction is to the left, the "rearward" direction is to the right, the "upward" direction is toward the top, the "downward" direction is toward the bottom, and the "lateral" direction is into and out of the paper (perpendicular to the plane of FIG. 3).

FIGS. 1-4 depict one embodiment of a rack 10 for displaying and first-in, first-out dispensing of a plurality of products P of substantially identical configuration each having a bottom end B configured for supporting the product in an upright orientation resting on the bottom end. The products can be, for example, bottles as shown. The rack 10 has a generally rectangular cuboid shape formed by a generally vertical first side wall 12 (FIG. 2) and an opposite second side wall 14 (FIG. 1) laterally spaced from and parallel to the first side wall, a generally horizontal top wall 16 joined to upper portions of the side walls, a generally horizontal bottom wall 18 joined to lower portions of the side walls, a generally vertical rear wall 20 (FIGS. 3 and 4) joined to rear portions of the side, top, and bottom walls, and a generally vertical front wall 22 (FIG. 2) joined to front portions of the side, top, and bottom walls. The rack also includes a generally vertical dividing wall 24 located between the side walls 12, 14, which divides the rack into first and second (or left and right) portions.

The rack 10 includes a loading chute 30 (FIG. 3) defined in the first (left-hand) portion of the rack between the first side wall 12 and the dividing wall 24. The loading chute is delimited in the vertical direction between the top wall 16 of the rack and a loading ramp 32. The loading chute has a loading aperture 31 defined through the front wall 22 proximate the top wall 16, through which products are loaded into the chute. Products P are loaded onto the loading ramp 32 in a generally horizontal orientation, bottom end B first, as shown in FIG. 3. Each product has a front side on which a label L is affixed. The label typically has text that the potential purchaser would like to be able to read, and also has graphics designed to make the product attractive to the purchaser. The products are loaded into the loading chute 30 with the front side facing downwardly, against the loading ramp 32. The loading ramp 32 can have at least a rear portion that slopes downwardly in the rearward direction, as best seen in FIG. 3. The downwardly sloping portion of the loading ramp need not be sloped steeply enough to cause the products to slide rearwardly solely by gravity, and in the illustrated embodiment, gravity alone likely would not cause the products to slide down the loading ramp. Indeed, it is not essential that the loading ramp be sloped downwardly at all, although some degree of downward slope toward the rear end of the loading chute is helpful.

Figure 2:
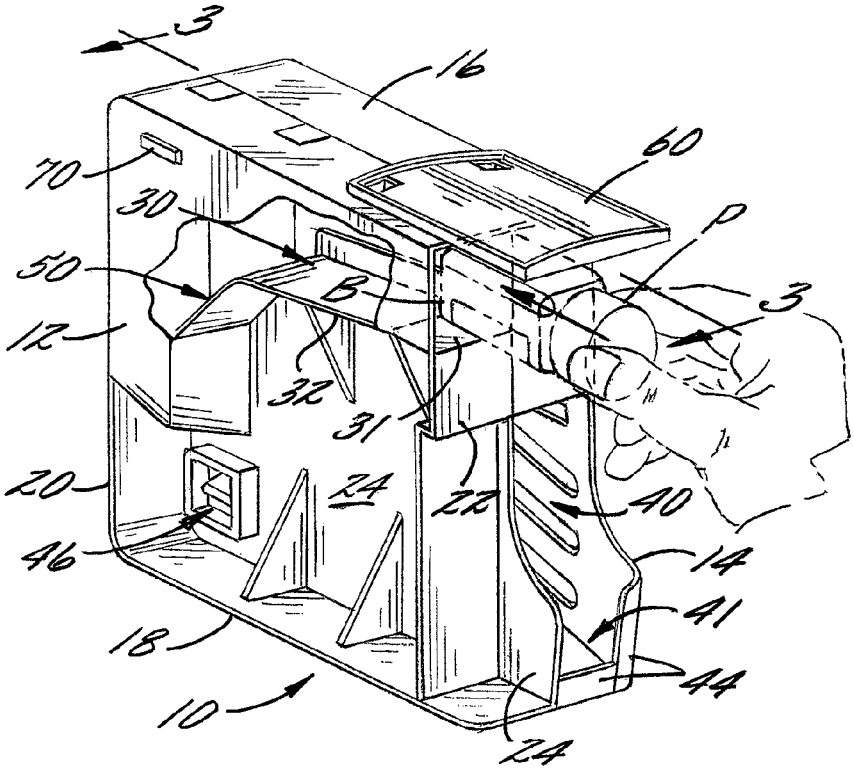
FIG. 2 is a perspective view generally toward an opposite second side of the rack in FIG. 1.

With primary reference to FIG. 2, in the illustrated embodiment, the first side wall 12, the loading ramp 32, a left-hand portion of the front wall 22, a left-hand portion of the bottom wall 18, a left-hand portion of the rear wall 20, and the dividing wall 24 are all integrally formed together as a first (left-hand) one-piece structure, such as a molded plastic structure.

Figure 4:
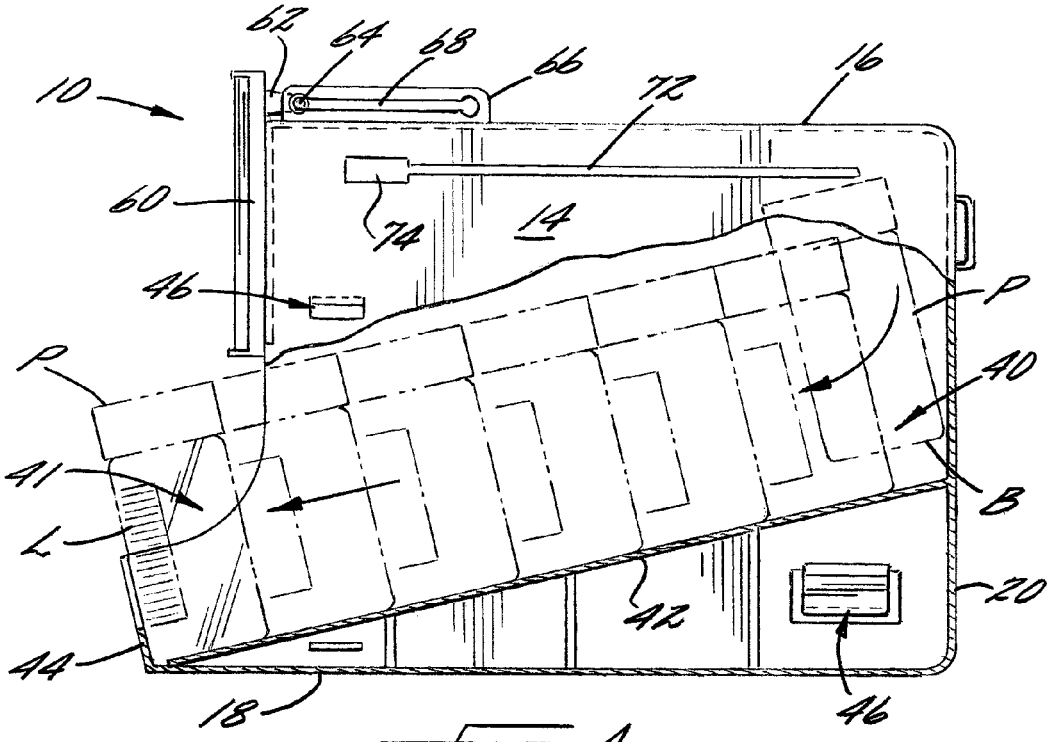
FIG. 4 is a side view of the first side of the rack, as viewed along the direction indicated by line 4-4 in FIG. 1, the rack being partly broken away to show the dispensing chute.

With primary reference to FIGS. 3 and 4, the rack also includes a dispensing chute 40 in the second (right-hand) portion of the rack. The dispensing chute is delimited in the lateral direction by the dividing wall 24 and the second side wall 14, and in the vertical direction by the top wall 16 and a dispensing ramp 42. The dispensing ramp 42 slopes downwardly in the forward direction, with a sufficiently steep slope to cause the products to slide forward solely by gravity. The rack includes a stop 44 at the forward end of the dispensing ramp 42 for stopping the products and preventing them from sliding out the forward end of the dispensing chute. For example, as shown, the stop 44 can comprise a short wall extending generally vertically upward from the front edge of the bottom wall and/or a short wall extending generally laterally from the front edge of the second side wall 14 generally toward the first side wall 12. The stop is just large enough to stop the products, without obscuring any significant extent of the label L.

As noted, the stop 44 halts the forward movement of the row of products and positions the forwardmost product in a position to be removed from the rack. In this regard, the dispensing chute 40 defines a dispensing aperture 41 (FIG. 2) through which the forwardmost product can be removed. Removal of the forwardmost product then causes the remaining row of products to slide down against the stop 44 to position the next product for removal. It is advantageous for the dispensing ramp 42 to extend farther forward than the front wall 22 and for lower portions of the second side wall 14 and the dividing wall 24 to also extend farther forward than the front wall to facilitate product removal through the dispensing aperture 41. In the illustrated embodiment, the dispensing aperture 41 is laterally offset from the loading aperture 31. Alternatively, however, the rack can be designed so that the loading aperture is directly above the dispensing aperture.

In the illustrated embodiment, the second side wall 14, the dispensing ramp 42, a right-hand portion of the bottom wall 18, a right-hand portion of the front wall 22, a right-hand portion of the top wall 16, and a right-hand portion of the rear wall 20 are all integrally formed together as a second (right-hand) one-piece structure, such as a molded plastic structure.

The first and second (left-hand and right-hand) structures of the rack are affixed to each other to form the rack. In this regard, the structures have interlocking elements such as shown generally at 46 and 48 that interlock to connect the structures together. The interlocking elements can be of various forms, and advantageously are releasable so that the structures can be separated if necessary.

Figure 1:
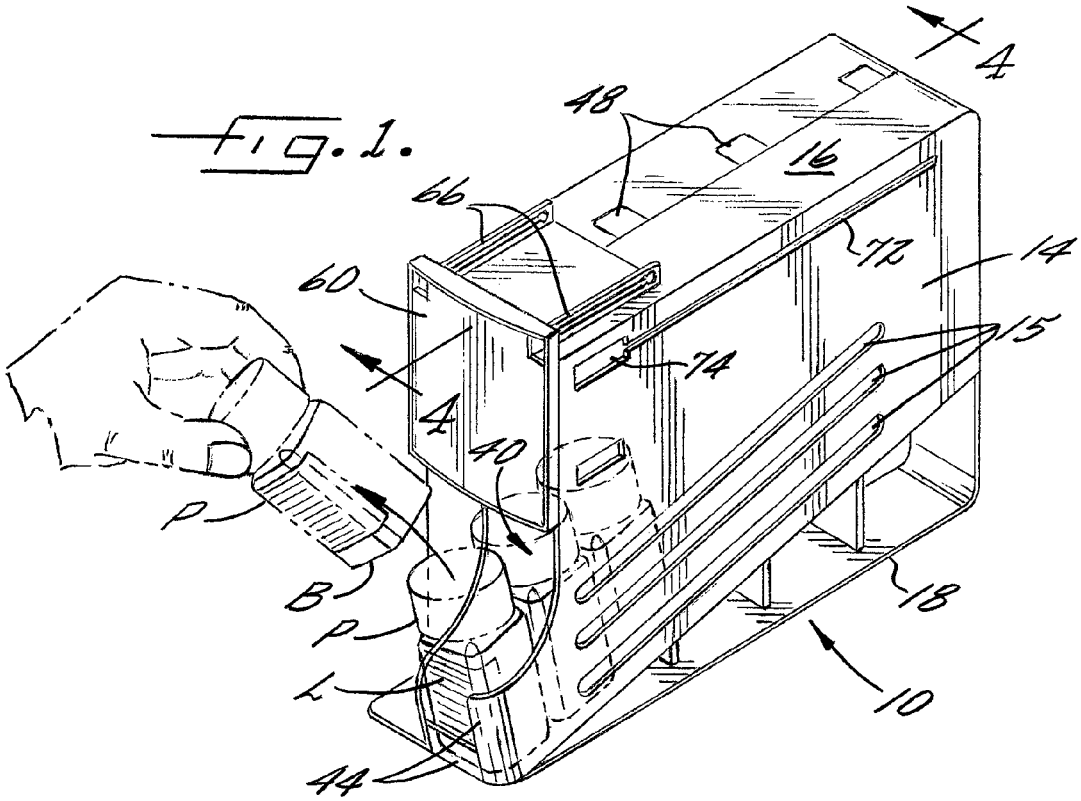
FIG. 1 is a perspective view generally toward a first side of a rack in accordance with one embodiment of the invention.
Figure 5:
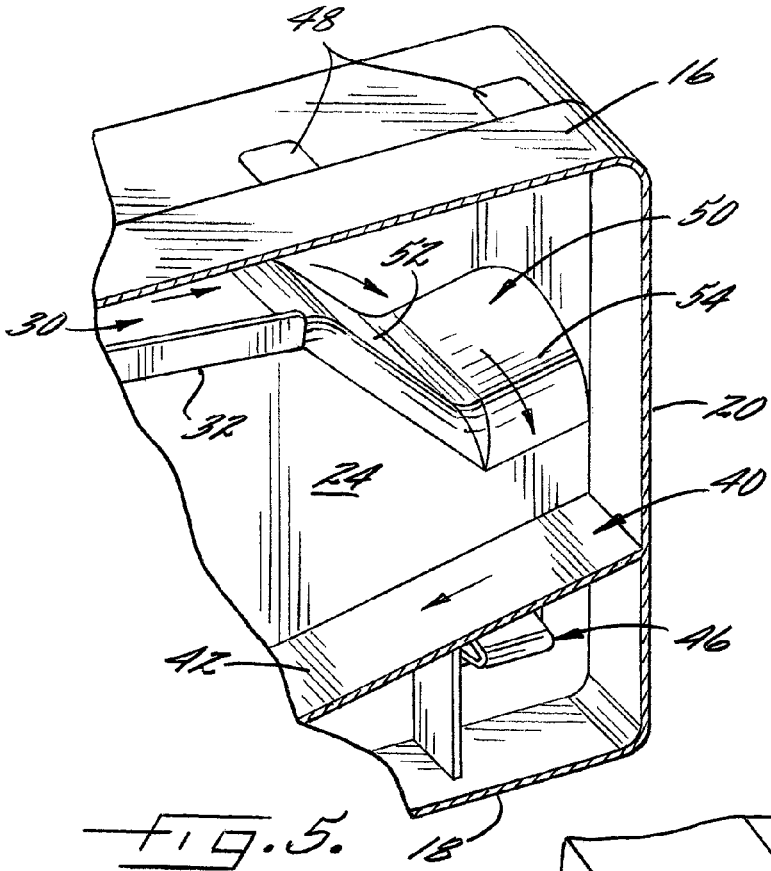
FIG. 5 is a perspective view of the rack partially broken away to show details of the cam.
Figure 6:
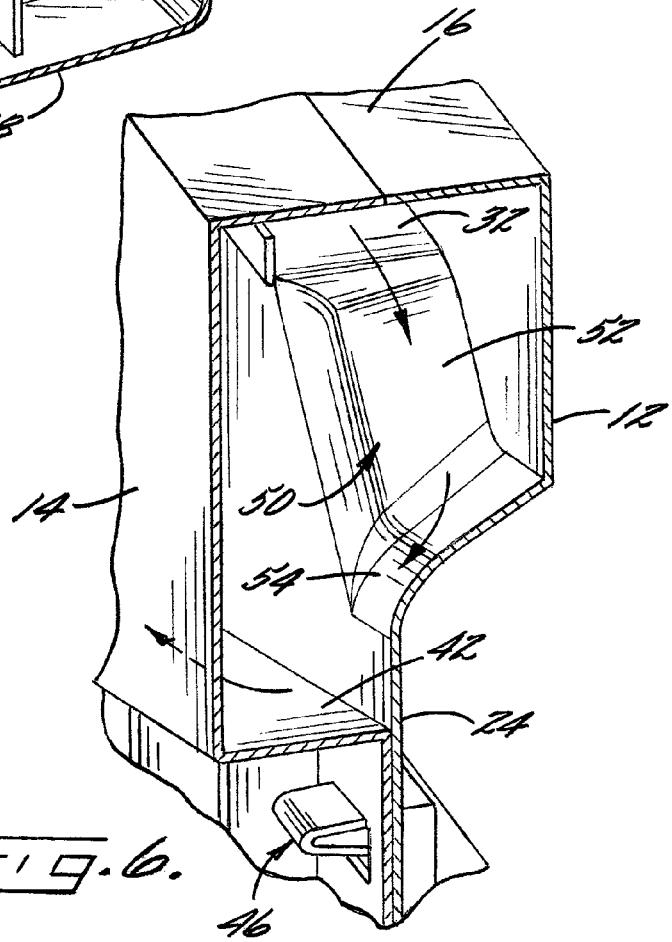
FIG. 6 is another perspective view of the rack partially broken away to show the cam.

Products loaded into the loading chute 30 must move from the loading chute into the dispensing chute 40. The products also must move from the generally horizontal orientation in the loading chute to an upright orientation in the dispensing chute as shown in FIGS. 1 and 4. Accordingly, with reference to FIGS. 3, 5, and 6, the rack includes a cam 50 at the rear end of the loading ramp 32. The cam advantageously is integrally formed with the loading ramp. The cam is configured to cause a product P sliding off the rear end of the loading ramp to (1) tip into a generally upright orientation resting on its bottom B (FIG. 3), and (2) slide laterally onto the rear end of the dispensing ramp 42 (FIG. 4). In this regard, the cam 50 includes a portion 52 that is sloped downwardly in the rearward direction with a steep slope that causes the product to be tipped into the upright orientation, and a portion 54 that slopes downwardly in the lateral direction toward the second side wall 14 to slide the upright product onto the dispensing ramp 42. In the illustrated embodiment, the two portions 52 and 54 are generally separate, but it is also possible for a single portion to be downwardly sloped in both the rearward and lateral directions to effect the needed movements of the product. In either case, the cam 50 is configured such that a product loaded into the loading chute with its label L facing downward is moved onto the dispensing ramp 42 with the label facing forward. This is most effectively accomplished with products that have a generally square or rectangular cross-section, although the rack can also be used with products of other cross-sections. With square or rectangular products, the dimensions of the loading and dispensing chutes can be selected to effectively prevent the products from rotating about their axes as they move through the rack, thereby ensuring that the labels will face forward as the products slide down the dispensing ramp.

The rack also includes further (optional) features. The second side wall 14 advantageously has at least one opening 15 to allow products P (or the lack of products, as the case may be) in the dispensing chute 40 to be seen, so that the person tending the rack can determine whether the rack needs to be filled or topped off with new products. Advantageously, the opening(s) 15 can be elongate and can extend from a location near the front end of the dispensing ramp 42 generally rearwardly to a location near the rear end of the dispensing ramp. Alternatively, a series of discrete openings spaced apart along the length of the dispensing ramp could be provided in the wall 14 for the same purpose.

Additionally, the rack can include a door 60 for covering the loading aperture 31 when the rack is not being loaded. In the illustrated embodiment, the door at its upper end has a pair of laterally spaced resilient ears 62 projecting rearwardly from the door near its opposite side edges, and a pin 64 or the like projects laterally from each ear toward the other ear. A distal end of each pin has an enlarged portion or head (not shown). The rack includes a pair of track members 66 formed on the top wall 16 adjacent the opposite side edges thereof.

Each track member defines an elongate slot 68 of smaller width (in the vertical direction) than the enlarged head of the pin 64. The door 60 is attached to the track members 66 by spreading the ears 62 apart and inserting the pins 64 through enlarged rear portions of the slots 68. The resilience of the ears allows them to return to their undeflected positions so that the door cannot readily be detached from the track members. The pins 64 can slide along the slots 68 for opening and closing the door. The door is shown open in FIG. 3 and closed in FIG. 4. The door and its connection to the rack as illustrated and described herein represent only one possible way to arrange a door, and the invention is not limited to any particular door arrangement. Indeed, the door is only optional and need not be included, although it is advantageous to include a door for reasons of aesthetics and for keeping debris from entering the loading chute. Furthermore, the front side of the door is useful for displaying graphics and/or text describing the products contained in the rack.

The rack can also include features that allow two or more of the racks to be connected together in a side-by-side arrangement. Thus, the first side wall 12 can include a first connecting member 70 (FIG. 2) and the second side wall 14 can include a second connecting member 72 (FIG. 1) configured to be engageable with the first connecting member of another one of the racks to secure the racks together in side-by-side fashion. As illustrated, the first connecting member 70 comprises a projection formed on the first side wall 12 and projecting laterally outwardly therefrom, and the second connecting member 72 comprises a slot formed through the second side wall 14. The projection has an enlarged portion at its distal end. The slot includes an enlarged portion 74 through which the projection can pass. The enlarged portion 74 of the slot is offset (in the front-to-back direction) from the projection 70. Two racks are attached to each other by inserting the projection 70 of one rack into the enlarged slot portion 74 of the other rack and then sliding the one rack rearwardly to slide the projection along the narrow portion of the slot. Other types of connecting members could be used for connecting racks together.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A rack for displaying and first-in, first-out dispensing of a plurality of products of substantially identical configuration each having a bottom end configured for supporting the product in an upright orientation resting on the bottom end, comprising:

a loading chute defining a loading aperture at a front side of the rack, the loading chute including a loading ramp extending rearwardly from the loading aperture to a rear end of the loading ramp, the loading chute being configured to receive the products one at a time, bottom end first, in a horizontal orientation with a front face of each product against the loading ramp;

a dispensing chute defining a dispensing aperture at the front side of the rack, the dispensing chute including a dispensing ramp that extends forwardly and slopes downwardly from a rear end of the dispensing ramp to a front end thereof, the rear end of the dispensing ramp being laterally adjacent the rear end of the loading ramp;

a cam extending between the rear ends of the loading and dispensing ramps, the cam comprising first and second cam portions that are generally separate and arranged sequentially such that a product sliding rearwardly along the loading ramp first encounters the first cam portion, the first cam portion sloping downwardly in a rearward direction at a substantially steeper angle than the rear end of the loading ramp so as to tilt a product sliding off the rear end of the loading ramp into an upright orientation with the front face of the product facing forward, the product next encountering the second cam portion, the second cam portion sloping downwardly in a lateral direction so as to move the upright product onto the rear end of the dispensing ramp with the front face still facing forward; and a stop positioned adjacent the dispensing aperture such that the upright product sliding down the dispensing ramp is stopped by the stop and is positioned to allow a consumer to withdraw the product from the dispensing aperture.

2. The rack of claim 1, wherein at least a rear portion of the loading ramp slopes downwardly in the rearward direction.

3. The rack of claim 1, wherein the loading aperture is laterally offset from the dispensing aperture.

4. The rack of claim 1, further comprising a generally vertical dividing wall that bounds one side of the dispensing chute.

5. The rack of claim 4, wherein the loading aperture is located proximate a top wall of the rack, the loading chute being bounded by the loading ramp, the top wall, the dividing wall, and a first side wall of the rack.

6. The rack of claim 5, wherein the dispensing chute is bounded by the dispensing ramp, the top wall, the dividing wall, and an opposite second side wall of the rack.

7. The rack of claim 6, further comprising a door connected to the rack so as to be movable between a closed position in which the door covers the loading aperture and an open position in which the loading aperture is accessible for loading products into the loading chute.

8. The rack of claim 6, wherein the second side wall has at least one opening therein allowing products in the dispensing chute to be viewed so that a degree of fullness of the dispensing chute can be visually detected.

9. The rack of claim 6, wherein the stop is proximate a front edge of the dividing wall and a front edge of the second side wall.

10. A front-loading, front-dispensing rack for displaying and first-in, first-out dispensing of products each having a generally square or rectangular cross-sectional shape and a bottom end configured for supporting the product in an upright orientation resting on the bottom end, comprising:

a loading ramp extending generally in a rearward direction from a front end of the loading ramp to a rear end thereof, and being configured to receive one of the products bottom end first, in a generally horizontal orientation;

a dispensing ramp extending generally in a forward direction from a rear end of the dispensing ramp to a front end thereof and being arranged laterally adjacent the loading ramp; and a cam extending between the rear end of the loading ramp and the rear end of the dispensing ramp, the cam comprising first and second cam portions that are generally separate and arranged sequentially such that a product sliding rearwardly along the loading ramp first encounters the first cam portion, the first cam portion sloping downwardly in the rearward direction at a substantially steeper angle than the rear end of the loading ramp for tilting a product sliding off the rear end of the loading ramp into a generally upright orientation resting on the bottom end of the product, the product next encountering the second cam portion, the second cam portion sloping downwardly in a lateral direction so as to move the upright product onto the rear end of the dispensing ramp;

the dispensing ramp sloping downwardly from the rear end to the front end thereof such that the upright product slides by gravity to the front end of the dispensing ramp.

11. The front-loading, front-dispensing rack of claim 10, further comprising a door connected to the rack and movable between a closed position blocking access to the loading ramp and an open position permitting access to the loading ramp.

12. The front-loading, front-dispensing rack of claim 10, wherein the dispensing ramp has a length in the forward direction substantially exceeding a width of the dispensing ramp in the lateral direction, whereby the dispensing ramp accommodates a plurality of upright products arranged contiguously one behind another.

13. The front-loading, front-dispensing rack of claim 12, wherein the loading ramp has a length in the forward direction sufficient to accommodate a plurality of horizontally oriented products arranged contiguously one behind another.

14. The front-loading, front-dispensing rack of claim 10, comprising opposite first and second side walls oriented generally vertically and generally parallel to each other, and a generally vertical dividing wall located intermediate the first and second side walls and generally parallel thereto, wherein the loading ramp extends laterally between the first side wall and the dividing wall, and the dispensing ramp extends laterally between the dividing wall and the second side wall.

15. The front-loading, front-dispensing rack of claim 14, further comprising a top wall joined with upper portions of the first and second side walls.

16. The front-loading, front-dispensing rack of claim 14, further comprising a bottom wall joined with lower portions of the first and second side walls.

17. The front-loading, front-dispensing rack of claim 14, further comprising a rear wall joined with rear portions of the first and second side walls.

18. The front-loading, front-dispensing rack of claim 14, wherein the first side wall has a first connecting member and the second side wall has a second connecting member configured to be engageable with the first connecting member of a second rack to secure the racks together in side-by-side fashion.

19. The front-loading, front-dispensing rack of claim 14, wherein the rack is formed in separate first and second portions that are joined together by cooperative fastening members integrally formed on the portions, the first portion including the first side wall, the loading ramp, the cam, and the dividing wall, and the second portion including the dispensing ramp and the second side wall.

20. The front-loading, front-dispensing rack of claim 14, wherein the loading ramp is sufficiently close to horizontal in orientation in the rearward direction that gravity alone is insufficient to cause the products to slide to and off the rear end of the loading ramp.

21. The front-loading, front-dispensing rack of claim 10, in combination with a plurality of products each having a generally square or rectangular cross-sectional shape and a label on a front face thereof, a row of the products being disposed one behind another at least in the dispensing chute with the labels facing forward.

22. The front-loading, front-dispensing rack of claim 21, further comprising at least one product in a horizontal orientation, with the label facing down, in the loading chute.

* * * * *